US008747080B2

(12) United States Patent
Kodama et al.

(10) Patent No.: US 8,747,080 B2
(45) Date of Patent: Jun. 10, 2014

(54) FLUID PUMP

(75) Inventors: Yukiharu Kodama, Nagaokakyo (JP); Atsuhiko Hirata, Nagaokakyo (JP); Kenta Omori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 76 days.

(21) Appl. No.: 13/418,459

(22) Filed: Mar. 13, 2012

(65) Prior Publication Data

US 2012/0171062 A1 Jul. 5, 2012

Related U.S. Application Data

(63) Continuation of application No. PCT/JP2011/061147, filed on May 16, 2011.

(30) Foreign Application Priority Data

May 21, 2010 (JP) ..... 2010-117546
Feb. 4, 2011 (JP) ..... 2011-022627

(51) Int. Cl.
*F04B 17/03* (2006.01)
*F04B 45/047* (2006.01)
*F04B 43/04* (2006.01)
*F04B 19/00* (2006.01)

(52) U.S. Cl.
CPC ..... *F04B 45/047* (2013.01); *F04B 43/046* (2013.01); *F04B 19/006* (2013.01)
USPC ..... 417/413.2

(58) Field of Classification Search
CPC ..... F04B 43/046; F04B 45/047; F04B 19/006
USPC ..... 417/413.2, 413.1, 410.2; 977/733, 724; 310/369
See application file for complete search history.

(56) References Cited

U.S. PATENT DOCUMENTS 4,939,405 A * 7/1990 Okuyama et al. ..... 310/330
2009/0148318 A1 6/2009 Kamitani et al.

(Continued)

FOREIGN PATENT DOCUMENTS

CN 101542122 A 9/2009
EP 2 123 913 A1 11/2009

(Continued)

OTHER PUBLICATIONS

Official Communication issued in International Patent Application No. PCT/JP2011/061147, mailed on Aug. 9, 2011.

(Continued)

*Primary Examiner* — Bryan Lettman
(74) *Attorney, Agent, or Firm* — Keating & Bennett, LLP

(57) ABSTRACT

A small-sized, low-profile fluid pump having high pumping capabilities includes an actuator and a planar section including a metal plate. The actuator includes a disk-shaped piezoelectric element attached to a disk-shaped diaphragm. As a result of application of a square-wave or sine-wave drive voltage, the actuator performs a bending vibration from the central portion to the peripheral portion. The peripheral portion of the actuator is not restrained. The actuator performs a bending vibration in the state in which it is in proximity to the planar section while facing the planar section. A center vent is provided at or in an area adjacent to the center of an actuator facing area of the planar section that faces the actuator.

6 Claims, 10 Drawing Sheets

(56) References Cited

U.S. PATENT DOCUMENTS

| | | | | |
|---|---|---|---|---|
| 2009/0232682 | A1 | 9/2009 | Hirata et al. | |
| 2009/0232685 | A1* | 9/2009 | Kamitani et al. | 417/413.2 |
| 2011/0076170 | A1 | 3/2011 | Fujisaki et al. | |

FOREIGN PATENT DOCUMENTS

| | | | |
|---|---|---|---|
| JP | 02-149880 | U | 12/1990 |
| JP | 2007-154784 | A | 6/2007 |
| JP | 2009-103111 | A | 5/2009 |
| JP | 2009-121323 | A | 6/2009 |
| JP | 2009-156253 | A | 7/2009 |
| JP | 2010-084527 | A | 4/2010 |
| JP | 5115626 | B2 | 1/2013 |
| WO | 2008/069264 | A1 | 6/2008 |
| WO | 2008/111397 | A1 | 9/2008 |
| WO | 2009/148008 | A1 | 12/2009 |

OTHER PUBLICATIONS

Official Communication issued in corresponding Japanese Patent Application No. 2012-515871, mailed on Oct. 1, 2013.

* cited by examiner

FLUID PUMP

BACKGROUND OF THE INVENTION

1. Field of the Invention

The present invention relates to a fluid pump suitable for moving a fluid, such as air or liquid.

2. Description of the Related Art

A piezoelectric pump of the related art is disclosed in International Publication No. 2008/069264. FIGS. 1A-1E illustrate a pumping operation of the piezoelectric pump disclosed in International Publication No. 2008/069264 in a third-order resonance mode. The piezoelectric pump includes a pump body 10, a diaphragm 20 having an outer peripheral portion thereof fixed to the pump body 10, a piezoelectric element 23 attached to the central portion of the diaphragm 20, a first opening 11 formed in the pump body 10 that faces a portion at or near the central portion of the diaphragm 20, and a second opening 12 formed in an intermediate area between the central portion and an outer peripheral portion of the diaphragm 20 or formed in the pump body 10 that faces this intermediate area. The diaphragm 20 is made of a metal plate, and the piezoelectric element 23 has a size such that the first opening 11 is covered but it does not to reach the second opening 12. A voltage having a predetermined frequency is applied to the piezoelectric element 23 so as to cause a portion of the diaphragm 20 that faces the first opening 11 and a portion of the diaphragm 20 that faces the second opening 12 to bend and deform in directions opposite to each other. As a result, a fluid is sucked into one of the first opening 11 and the second opening 12, and is discharged from the other one of the second opening 12 and the first opening 11.

A piezoelectric pump, such as that shown in FIGS. 1A-1E, has a simple structure so that it can be formed as a thin pump. Accordingly, the piezoelectric pump is used as, for example, an air transport pump in a fuel cell system.

However, electronic devices into which such a piezoelectric pump is integrated are becoming smaller, and accordingly, it is also desirable to reduce the size of a piezoelectric pump without decreasing the capabilities (flow rate and pressure) of the pump. Moreover, in accordance with a reduced power supply voltage of an electronic device into which a piezoelectric pump is integrated, it is desirable to reduce a drive voltage. As the size of a piezoelectric pump or the drive voltage decreases, capabilities (flow rate and pressure) of the pump are decreased. Accordingly, when using a piezoelectric pump having a structure of the related art, there are limitations on reducing the size of the piezoelectric pump while maintaining capabilities of the pump and on enhancing capabilities of the pump without increasing the size of the piezoelectric pump.

In a fluid pump provided with a diaphragm of the related art, an increase in the size of the diaphragm is effective for increasing the flow rate. This, however, causes not only an increase in the size of the entire fluid pump, but also an increase in the generation of audible sound because of a low operating frequency.

SUMMARY OF THE INVENTION

Accordingly, preferred embodiments of the present invention provide a small-sized, low-profile fluid pump that achieves high pumping capabilities.

A fluid pump of the related art has a structure in which a diaphragm that is rigid enough to resist pressure is driven and the peripheral portion of the diaphragm is fixed to a pump body. Because of this structure, although a drive voltage is high, only a small pressure level and a small flow rate are obtained. In view of these problems, fluid pumps according to various preferred embodiments of the present invention are configured as follows.

A fluid pump according to a preferred embodiment of the present invention includes an actuator including a central portion and a peripheral portion which is not substantially restrained, the actuator being arranged to perform a bending vibration from the central portion to the peripheral portion; a planar section disposed such that the planar section faces the actuator and is adjacent to the actuator; and at least one center vent disposed in a portion located at or in an area adjacent to a center of an actuator facing area of the planar section that faces the actuator.

With this arrangement, since the peripheral portion (and the central portion) of the actuator is not restrained, loss caused by a bending vibration of the actuator is prevented and suppressed. Accordingly, a high pressure level and a large flow rate can be obtained although the fluid pump is small-sized and low-profile.

The actuator may preferably have a disk-shaped configuration. In this case, since the actuator performs a circularly-symmetric (concentric) bending vibration, an unnecessary gap is not produced between the actuator and the planar section, thereby improving the operation efficiency as the pump.

In the actuator facing area of the planar section, the portion located at or in an area adjacent to the center of the actuator facing area may preferably include a thin sheet portion that performs a bending vibration, and a peripheral portion of the actuator facing area may preferably include a thick plate portion that is substantially restrained.

With this structure, since the thin sheet portion of the actuator facing area vibrates around the vent in accordance with the vibration of the actuator, the vibration amplitude can be substantially increased, thereby increasing the pressure and the flow rate.

The fluid pump may further include a cover plate unit that is bonded to the thick plate portion such that the cover plate faces the thin sheet portion so as to define an internal space together with the thin sheet portion and the thick plate portion. At least one vent groove arranged to allow the internal space to communicate with an outside of a housing of the fluid pump may be provided in the cover plate unit.

With this structure, the pressure and the flow rate that can be generated, i.e., pumping capabilities, can be significantly improved. The reason for this may be as follows. Because of the provision of the cover plate unit, the generation of a pressure wave or a synthetic jet flow around at least one center vent of the planar section caused by vibration of the actuator and the thin sheet portion of the planar section is prevented and suppressed.

One or a plurality of peripheral vents may be provided at a peripheral portion of the actuator facing area. With this arrangement, a positive pressure produced in the peripheral portion of the actuator facing area can be utilized, thereby making it possible to perform suction/discharge in the same plane.

The actuator may be retained by an elastic structure such that a certain gap is provided between the actuator and the planar section. With this arrangement, the gap between the actuator and the planar section can be automatically changed in accordance with a load change. For example, during a low load operation, the gap is secured positively, thereby increasing the flow rate. On the other hand, during a high load operation, the spring terminals deflect so as to automatically decrease the gap of the area where the actuator and the planar section face each other, whereby an operation can be performed at high pressure.

A position retaining structure including an opening arranged to position the actuator may be provided on the planar section, and the actuator may be accommodated within the opening. With this arrangement, the actuator can be prevented from being displaced without restraining the actuator by the planar section.

According to various preferred embodiments of the present invention, loss caused by a bending vibration of the actuator is small, and a high pressure level and a large flow rate can be obtained although the fluid pump is small-sized and low-profile.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
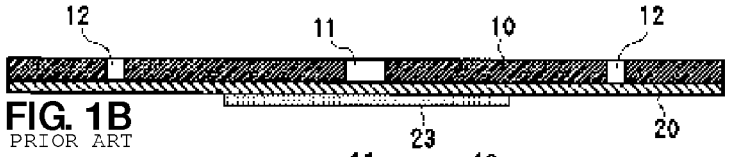
FIG. 1A PRIOR ART
FIGS. 1A-1E illustrates a pumping operation of a piezoelectric pump disclosed in International Publication No. 2008/069264 in a third-order resonance mode.
Figure 1B:
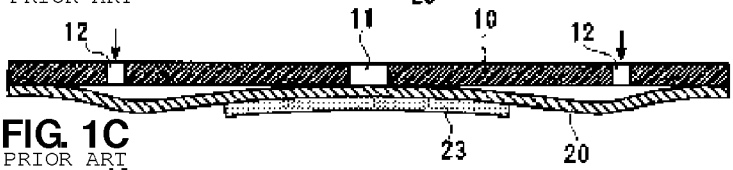
FIG. 1B PRIOR ART
Figure 1C:
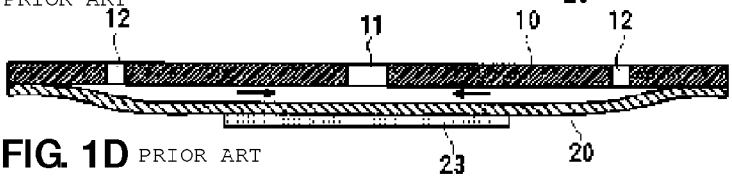
FIG. 1C PRIOR ART
Figure 1D:
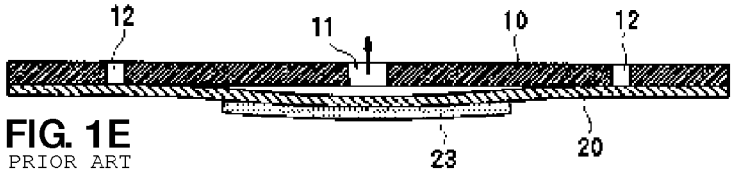
FIG. 1D PRIOR ART
Figure 1E:
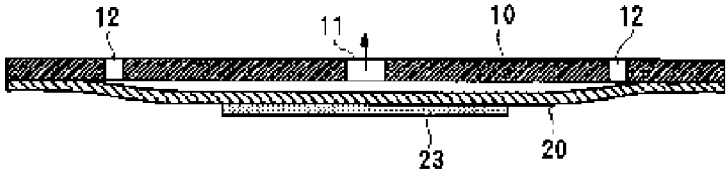
FIG. 1E PRIOR ART
Figure 2A:
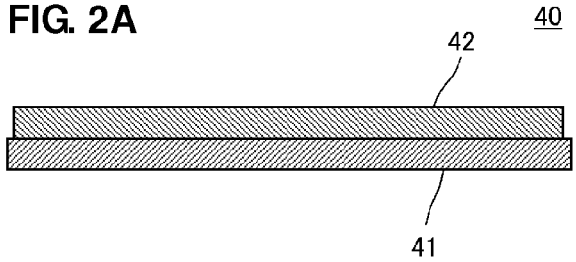
FIG. 2A is a sectional view illustrating the center of an actuator 40 provided in a fluid pump according to a first preferred embodiment of the present invention.
Figure 2B:
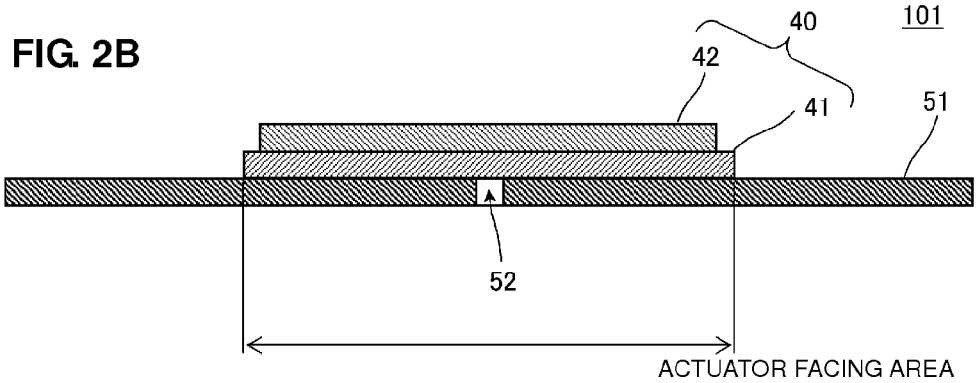
FIG. 2B is a sectional view illustrating the major part of a fluid pump 101 according to the first preferred embodiment of the present invention.

FIG. 2A is a sectional view illustrating the center of an actuator 40 provided in a fluid pump according to a first preferred embodiment. FIG. 2B is a sectional view illustrating the major portion of a fluid pump 101 in the non-driving state according to the first preferred embodiment. The actuator 40 is preferably formed by attaching a disk-shaped piezoelectric element 42 to a disk-shaped diaphragm 41. The diaphragm 41 is preferably made of metal, such as stainless steel or phosphor bronze, for example. An electrode film is arranged over almost the entirety of each of the top and bottom surfaces of the piezoelectric element 42. The electrode disposed on the bottom surface of the piezoelectric element 42 is electrically connected to or capacitively coupled to the diaphragm 41. A conductor wire is connected to the electrode located on the top surface of the piezoelectric element 42, and a drive circuit is electrically connected to this conductor wire and the diaphragm 41. Then, a square-wave or sine-wave drive voltage is applied to the actuator 40. The actuator 40 performs a circularly-symmetric (concentric) bending vibration from the central portion to the peripheral portion.

As illustrated in FIG. 2B, the fluid pump 101 includes the actuator 40 and a planar section 51 which is preferably made of a metal plate, such as stainless steel or phosphor bronze, for example. The actuator 40 is placed on (in contact with) the planar section 51. In FIG. 2B, the fluid pump 101 in the non-driving state is shown, and thus, the actuator 40 appears to be fixed to the planar section 51. However, the peripheral portion of the actuator 40 is not restrained by the planar section 51. Only when the fluid pump 101 is not driven is the actuator 40 placed opposite the planar section 51 such that it is in contact with the planar section 51. A center vent 52 is provided at or near the center of an area of the planar section 51 that faces the actuator 40 (hereinafter such an area is referred to as the "actuator facing area").

Figure 3A:
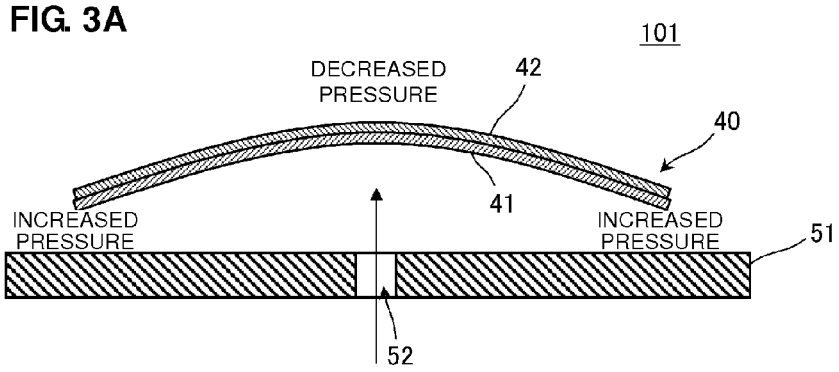
FIG. 3A illustrates the principle of the operation of the fluid pump 101.
Figure 3B:
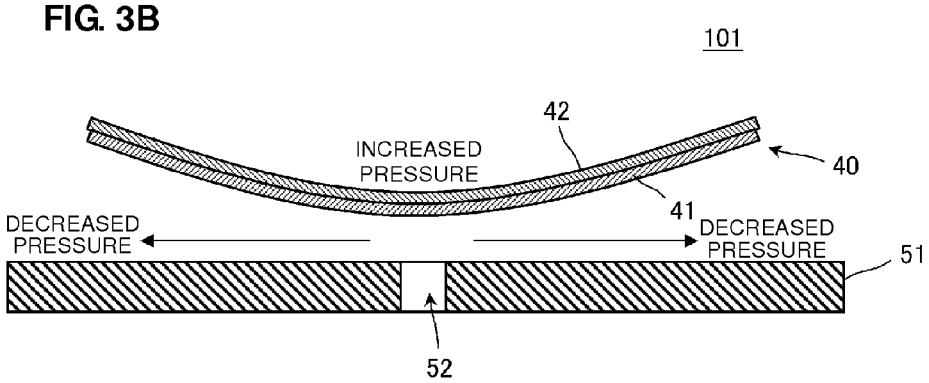
FIG. 3B illustrates the principle of the operation of the fluid pump 101.

FIGS. 3A and 3B are schematic views illustrating the principle of the operation of the fluid pump 101. This is an example in which the fluid pump 101 is operated at a frequency of about 20 kHz, and the amount of deformation of the actuator is exaggerated for ease of representation.

With the application of a voltage to the actuator, the actuator bends and deforms into a convex or concave shape. If the actuator 40 bends and deforms upward into a convex shape, as shown in FIG. 3A, the gap between the peripheral portion of the actuator 40 and the planar section 51 becomes smaller than the gap between the central portion of the actuator 40 and the planar section 51, thereby increasing the pressure around the gap between the peripheral portion and the planar section 51. Meanwhile, the gap between the central portion of the actuator and the planar section 51 becomes larger and decreases the pressure (producing a negative pressure) in a space between the central portion of the actuator 40 and the planar section 51, thereby allowing a fluid (e.g., air) to flow into this space through the center vent 52. In this case, a fluid also tries to flow through the gap between the peripheral portion of the actuator 40 and the planar section 51, or a small amount of fluid actually flows through the gap. However, the gap between the peripheral portion of the actuator 40 and the planar section is small, and thus, the channel resistance of the gap is large. Accordingly, the flow rate of a fluid flowing through the center vent 52 from the outside is much larger than that flowing through the gap between the peripheral portion of the actuator 40 and the planar section 51. As a result, a certain volume of fluid flowing through the center vent 52 can be secured.

Subsequently, if the actuator 40 bends and deforms downward into a convex shape, as shown in FIG. 3B, the gap between the central portion of the actuator 40 and the planar section 51 becomes smaller than the gap between the peripheral portion of the actuator 40 and the planar section 51, thereby increasing the pressure around the gap between the central portion of the actuator 40 and the planar section 51. Meanwhile, the gap between the peripheral portion of the actuator 40 and the planar section 51 increases and decreases the pressure in the gap between the peripheral portion of the actuator 40 and the planar section 51. Accordingly, a fluid flows out peripherally (radially) from a space between the central portion of the actuator 40 and the planar section 51. In this case, the fluid tries to flow back from the center vent 52 to the outside, or a small amount of fluid actually flows back from the center vent 52 to the outside. However, the gap between the peripheral portion of the actuator 40 and the planar section 51 is large, and thus, the channel resistance of the gap is small. Accordingly, the flow rate of a fluid flowing out from the gap between the peripheral portion and the planar section 51 is much larger than that flowing through the center vent 52. As a result, the flow rate of fluid flowing back to the outside through the center vent 52 can be significantly reduced.

In the above-described actuator, the central portion of the actuator 40 and the peripheral portion vertically vibrate in a range of several μm to several tens of μm, for example, assuming that the height of center of gravity is an average height.

The above-described operation is repeatedly performed at a resonant frequency in a first mode of the actuator 40, e.g., at a frequency of about 20 kHz, thereby performing a pumping operation to suck a fluid through the center vent 52 and discharge a fluid to the peripheral portion. Since the peripheral portion of the actuator 40 is not retained against the planar section 51, a sufficient level of amplitude can be obtained even though the actuator 40 is small.

The pressure at the central portion and the pressure at the peripheral portion of the actuator 40 momentarily change in accordance with a bending vibration of the actuator 40. However, if the pressure levels are averaged by time, a negative pressure is produced at the central portion, whereas a positive pressure is produced at the peripheral portion while being balanced against the negative pressure. Accordingly, while the actuator 40 is being driven, it is retained in proximity to the planar section 51 such that it is not in contact with the planar section 51. It is noted, however, that the pressure at the central portion and the pressure at the peripheral portion are changed due to the external pressure at a suction side and the external pressure at a discharge side. That is, the pressure at the central portion and the pressure at the peripheral portion are changed due to a load variation imposed on the pump.

In the fluid pump 101 shown in FIGS. 2A and 2B, as a higher load is imposed, i.e., as the difference between the pressure of the central portion of the actuator 40 and the pressure of the peripheral portion of the actuator 40 is larger, the average height of the actuator 40 with respect to the planar section 51 decreases. If a pumping operation is performed at a high load, i.e., by producing a large pressure difference, the gap between the actuator 40 and the planar section 51 decreases to such a degree that the actuator 40 comes into contact with the planar section 51. Even in this case, the pumping operation is performed without any trouble.

In a fluid pump using a diaphragm of the related art, such as that disclosed in International Publication No. 2008/069264, the peripheral portion of the diaphragm that performs a bending vibration is fixed to the planar section in a restrained manner. In contrast, in the fluid pump of a preferred embodiment of the present invention, although a bending vibration is utilized, a free vibration is performed such that the peripheral portion of the actuator is not fixed to the planar section in a restrained manner, but is elevated from the planar section in a non-contact state. With this configuration, a small-sized, low-profile fluid pump exhibiting a high pressure level and a large flow rate, which cannot be obtained by a fluid pump using a diaphragm of the related art, can be provided. Since the peripheral portion of the actuator is not fixed to the planar section, a sufficient level of amplitude can be obtained even if the actuator is designed to have high natural frequencies. It is even possible to easily design an actuator to be driven at a resonant frequency in an inaudible range at about 20 kHz or higher, for example.

In order to form the fluid pump shown in FIGS. 2A and 2B, only the planar section 51, the actuator 40, and a space equal to the gap therebetween are stacked in the thickness direction. Accordingly, a fluid pump having a very low profile, e.g., about 0.5 mm, can be provided.

The principle that the actuator 40 is retained against the planar section 51 in a non-contact state is similar to the so-called "squeeze effect" or "squeeze film effect". However, since various preferred embodiments of the present invention use a bending vibration, the principle used in preferred embodiments of the present invention is different from the "squeeze effect" or "squeeze film effect" in that the phase of the pressure of the central portion differs from that of the peripheral portion and that the gap is adjusted autonomously in accordance with a load variation imposed on the pump while maintaining the non-contact state of the actuator.

Second Preferred Embodiment

Figure 4:
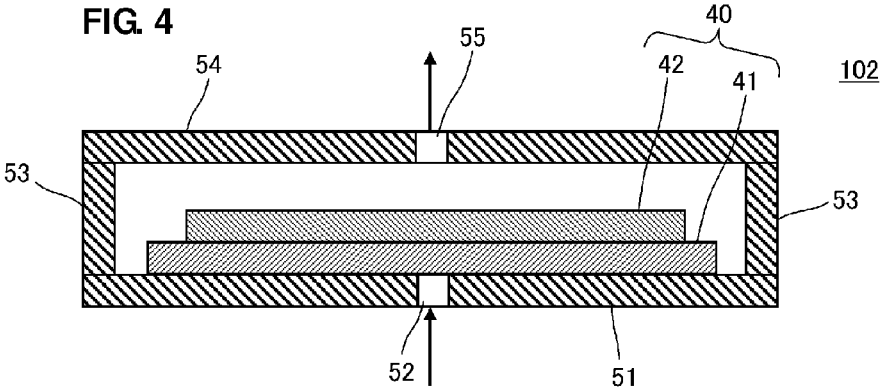
FIG. 4 is a sectional view illustrating the major portion of a fluid pump 102 according to a second preferred embodiment of the present invention.

FIG. 4 is a sectional view illustrating the major portion of a fluid pump 102 in a non-driving state according to a second preferred embodiment. The fluid pump 102 includes an actuator 40 and a planar section 51. In the actuator 40, a disk-shaped piezoelectric element 42 is attached to a disk-shaped diaphragm 41. On the top of the planar section 51, a spacer 53 and a lid 54 are provided to surround the periphery of the actuator 40. A discharge vent 55 is preferably provided in the lid 54. The actuator 40 is similar to that of the first preferred embodiment, and the peripheral portion thereof is not restrained by the planar section 51. Only when the fluid pump 102 is not driven is the actuator 40 placed opposite the planar section 51 such that it is in contact with the planar section 51.

When the actuator 40 performs a bending vibration, a fluid is sucked through a center vent 52 in accordance with the principle described in the first preferred embodiment. The sucked fluid is then discharged from the discharge vent 55. Accordingly, the fluid pump 102 has both sucking and discharging functions.

Third Preferred Embodiment

Figure 5:
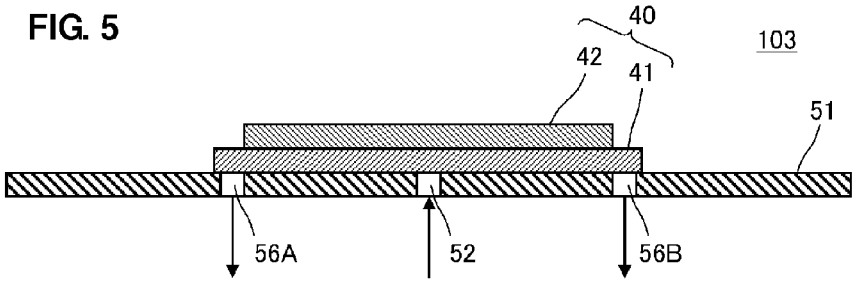
FIG. 5 is a sectional view illustrating the major portion of a fluid pump 103 according to a third preferred embodiment of the present invention.

FIG. 5 is a sectional view illustrating the major portion of a fluid pump 103 according to a third preferred embodiment. The fluid pump 103 includes an actuator 40 and a planar section 51 preferably made of a metal plate, such as stainless steel or phosphor bronze, for example. The peripheral portion of the actuator 40 is not restrained by the planar section 51.

Only when the fluid pump 103 is not driven is the actuator 40 placed opposite the planar section 51 such that it is in contact with the planar section 51. A center vent 52 is preferably provided at or in an area adjacent to the center of an area of the planar section 51 that faces the actuator 40 (actuator facing area). A plurality of peripheral vents 56A, 56B, etc. are also preferably provided at the peripheral portion of the actuator facing area.

Concerning the pressure of the gaps in the actuator facing area, both the pressure of the central portion and the pressure of the peripheral portion momentarily change in accordance with a bending vibration of the actuator 40. However, if the pressure levels are averaged by time, a negative pressure is produced at the central portion, whereas a positive pressure is produced at the peripheral portion while being balanced against the negative pressure. Accordingly, while the actuator 40 is being driven, it is retained in proximity to the actuator facing area such that it is not in contact with the actuator facing area. Thus, by providing the peripheral vents at the peripheral portion of the actuator facing area, a positive pressure is produced in the peripheral vents.

By providing the peripheral vents 56A, 56B, etc. at the peripheral portion of the actuator facing area in this manner, a positive pressure produced at the peripheral portion can be utilized, and thus, the difference between the positive pressure and the negative pressure produced at the central portion can be utilized, thereby making it possible to extract a larger difference of the pressure. Accordingly, the peripheral vents 56A, 56B, etc. may be directly used as discharge vents of the pump. Alternatively, a discharge vent may be provided at a certain area of a housing (not shown) and may be communicated with the peripheral vents, whereby discharge can be intensively performed.

By providing peripheral vents at the peripheral portion of the actuator facing area in this manner, a positive pressure produced in the peripheral portion can be utilized, thereby making it possible to perform suction/discharge in the same plane.

However, during a low load operation in which the difference in the pressure between the central portion and the peripheral portion of the actuator 40 becomes small, the gap at the peripheral portion decreases so as to increase pressure loss. Accordingly, the flow rate may decrease in comparison with the first and second preferred embodiments.

Fourth Preferred Embodiment

Figure 6:
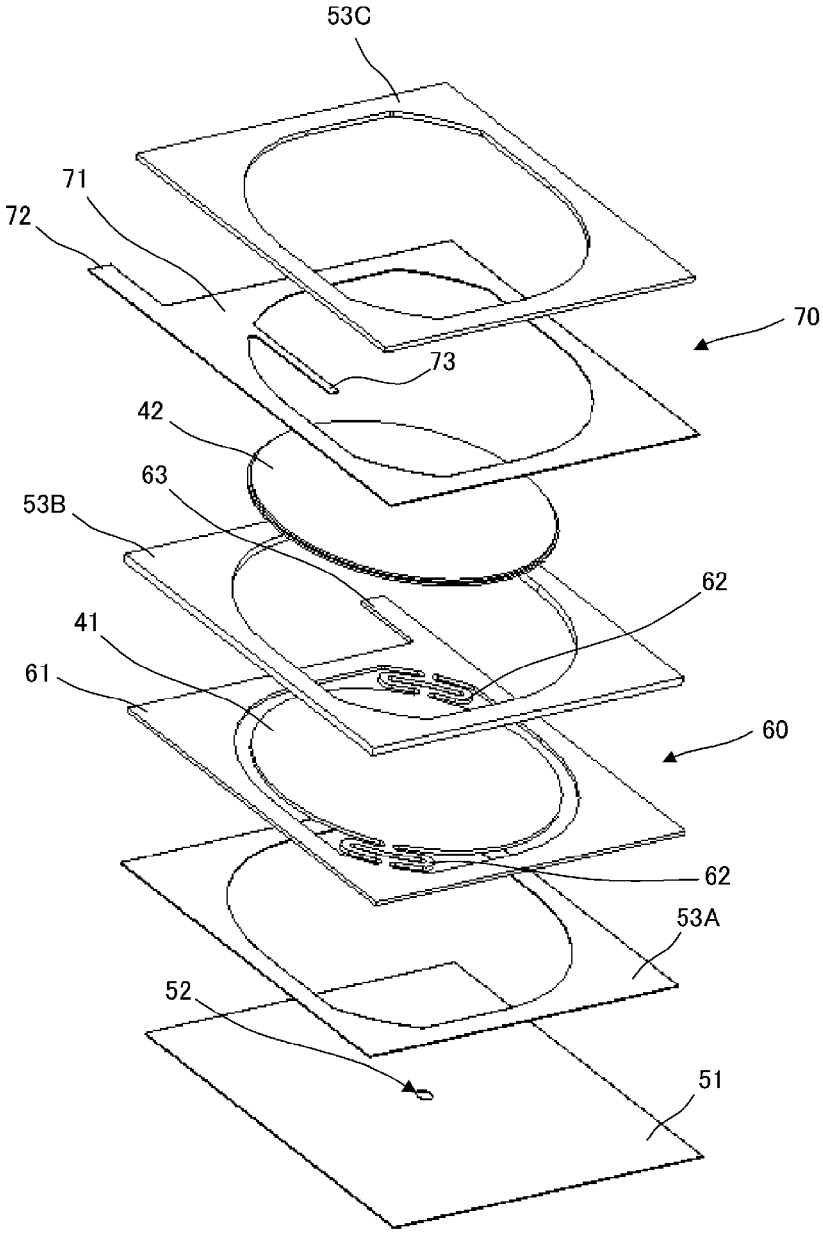
FIG. 6 is an exploded perspective view illustrating a portion of a fluid pump according to a fourth preferred embodiment of the present invention.
Figure 7:
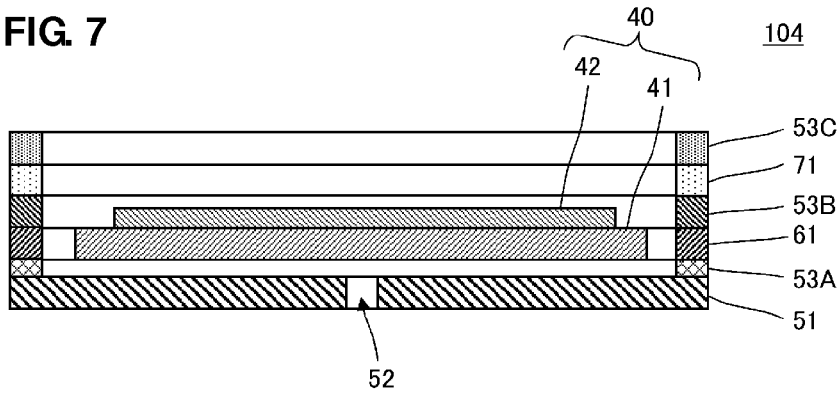
FIG. 7 is a sectional view illustrating the major portion of a fluid pump 104 according to the fourth preferred embodiment of the present invention.

FIG. 6 is an exploded perspective view illustrating a portion of a fluid pump 104 according to a fourth preferred embodiment. FIG. 7 is a sectional view illustrating the major portion of the fluid pump 104 according to the fourth preferred embodiment.

A piezoelectric element 42 is attached to the top surface of a disk-shaped diaphragm 41, and the diaphragm 41 and the piezoelectric element 42 define an actuator.

A diaphragm support frame 61 is provided around the diaphragm 41, and the diaphragm 41 is connected to the diaphragm support frame 61 through connecting portions 62. The connecting portions 62 preferably have a narrow ring-shaped configuration and an elastic structure provided with elasticity having a small spring constant. Accordingly, the diaphragm 41 is flexibly supported at two points by the diaphragm support frame 61 with the two connecting portions 62. Such a structure negligibly interferes with a bending vibration of the diaphragm 41. That is, in a practical sense, the peripheral portion (and the central portion) of the actuator is not restrained. A spacer 53A is arranged so that a diaphragm unit 60 is retained against a planar section 51 with a certain gap. An external terminal 63 to electrically connect the diaphragm 41 is provided for the diaphragm support frame 61.

The diaphragm 41, the diaphragm support frame 61, the connecting portions 62, and the external terminal 63 are preferably formed by punching from a metal plate, for example, to thereby form the diaphragm unit 60.

In accordance with the coefficient of linear expansion of the piezoelectric element 42, the diaphragm unit 60 is preferably made of a material having a coefficient of linear expansion similar to the piezoelectric element 42, for example, nickel (42Ni-58Fe). This can prevent the occurrence of warpage caused by thermosetting when the piezoelectric element 42 is attached to the diaphragm unit 60.

A resin spacer 53B is bonded onto the peripheral portion of the diaphragm unit 60. The thickness of the spacer 53B is the same as or slightly thicker than the piezoelectric element 42. The spacer 53B defines a portion of the housing and also electrically insulates the diaphragm unit 60 from an electrode conducting plate 70, which will be discussed below.

The electrode conducting plate 70 preferably made of metal is bonded onto the spacer 53B. The electrode conducting plate 70 includes a generally circular opening, an internal terminal 73 that projects into this opening, and an external terminal 72 that projects toward the outside.

The forward end of the internal terminal 73 is soldered to the surface of the piezoelectric element 42. In this case, the internal terminal 73 is soldered to a position of the piezoelectric element 42 corresponding to the node of a bending vibration of the actuator, thereby preventing the internal terminal 73 from vibrating.

A resin spacer 53C is bonded onto the electrode conducting plate 70. The thickness of the spacer 53C is similar to that of the piezoelectric element 42. A housing lid, which is not shown, is bonded onto the spacer 53C, and at least one vent is provided in a portion of the housing lid, thereby allowing a fluid to be discharged from the at least one vent. The spacer 53C prevents the soldered portion of the internal terminal 73 from being in contact with the housing lid (not shown) when the actuator vibrates. The spacer 53C also prevents the vibration amplitude from reducing due to air resistance because the surface of the piezoelectric element 42 excessively approaches the housing lid, which is not shown. Accordingly, as stated above, the thickness of the spacer 53C preferably is similar to that of the piezoelectric element 42.

A center vent 52 is preferably provided at the center of the planar section 51. The spacer 53A having a thickness of about several tens of μm, for example, is inserted between the planar section 51 and the diaphragm unit 60. In this manner, in spite of the presence of the spacer 53A, the gap is automatically changed in accordance with a load variation since the diaphragm 41 is not restrained by the diaphragm support frame 61. However, the diaphragm 41 is slightly influenced by the provision of spring terminals, and thus, by inserting the spacer 53A, the gap is secured so as to increase the flow rate during a low load operation positively. On the other hand, even though the spacer 53A is inserted, the spring terminals deflect during a high load operation so as to automatically decrease the gap of the area where the actuator 40 and the planar section 51 face each other, whereby an operation can be performed at high pressure.

In the example shown in FIG. 6, the connecting portions 62 preferably are provided at two points of the diaphragm support frame 61. Alternatively, the connecting portions 62 may be provided at three points of the diaphragm support frame 61. Although the connecting portions 62 do not interfere with vibration of the actuator 40, they may produce slight influence on vibration. Accordingly, by connecting (retaining) the diaphragm 41 by using the connecting portions 62 at three points, the diaphragm 41 can be retained more naturally, thereby preventing the piezoelectric element from cracking.

Fifth Preferred Embodiment

Figure 8:
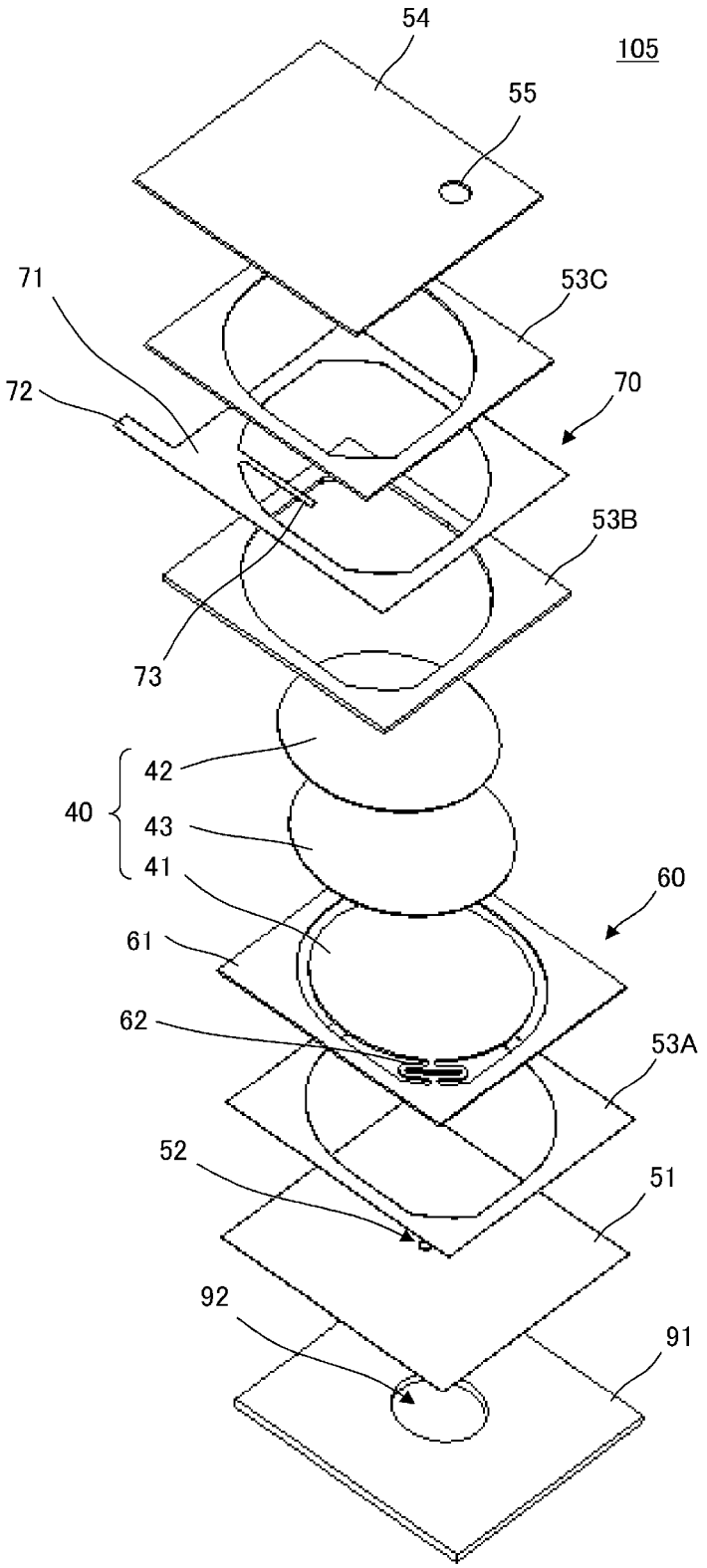
FIG. 8 is an exploded perspective view of a fluid pump 105 according to a fifth preferred embodiment of the present invention.
Figure 9:
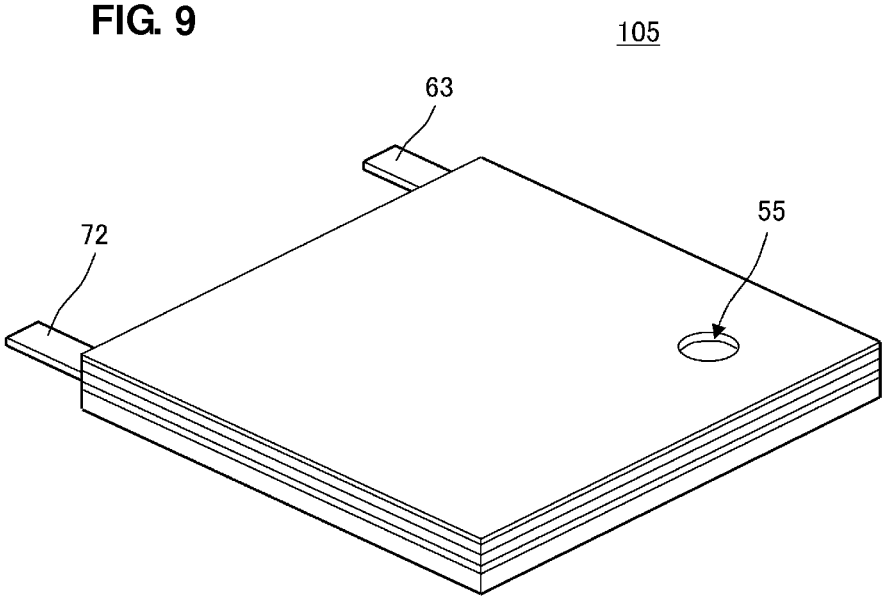
FIG. 9 is a perspective view illustrating the fluid pump 105.
Figure 10:
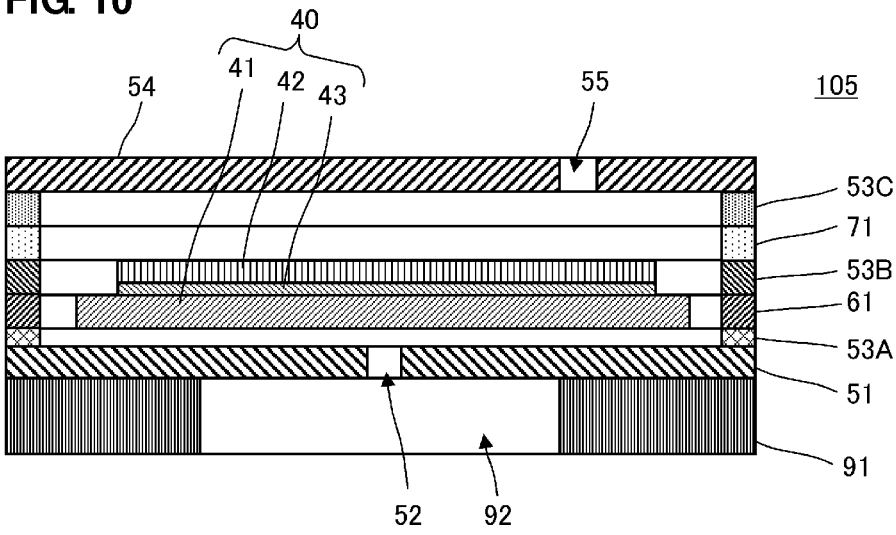
FIG. 10 is a sectional view illustrating the major portion of the fluid pump 105.

FIG. 8 is an exploded perspective view of a fluid pump 105 according to a fifth preferred embodiment. FIG. 9 is a perspective view illustrating the fluid pump 105. FIG. 10 is a sectional view illustrating the major portion of the fluid pump 105.

The fluid pump 105 includes a substrate 91, a planar section 51, a spacer 53A, a diaphragm unit 60, a reinforcing plate 43, a piezoelectric element 42, a spacer 53B, an electrode conducting plate 70, a spacer 53C, and a lid 54. Among those components, the configurations of the diaphragm unit 60, the piezoelectric element 42, the spacer 53A, the electrode conducting plate 70, and the spacer 53C preferably are similar to those of the fluid pump shown in FIG. 6.

The reinforcing plate 43 is inserted between the piezoelectric element 42 and the diaphragm 41. A metal plate having a larger coefficient of linear expansion than the piezoelectric element 42 and the diaphragm 41 is used as the reinforcing plate 43. This can prevent warpage of the overall actuator 40 caused by thermosetting when the piezoelectric element 42 is attached to the diaphragm 41, and allow an appropriate compressive stress to remain in the piezoelectric element 42, thereby preventing the piezoelectric element 42 from cracking. For example, a material having a small coefficient of linear expansion, such as 42 nickel (42Ni-58Fe) or 36 nickel (36Ni-64Fe), may be used for the diaphragm 41, while stainless steel SUS430 may be used for the reinforcing plate 43, for example. If a reinforcing plate is used, the thickness of the spacer 53B may be equal to or slightly thicker than the total thickness of the piezoelectric element 42 and the reinforcing plate 43. Concerning the stacking order of the diaphragm 41, the piezoelectric element 42, and the reinforcing plate 43, they may be stacked in the order of the piezoelectric element 42, the diaphragm 41, and the reinforcing plate 43 from above. In this case, too, the coefficient of linear expansion of each member is adjusted so as to allow an appropriate compressive stress to remain in the piezoelectric element 42.

The substrate 91 including a cylindrical opening 92 at the center is provided under the planar section 51. A portion of the planar section 51 is exposed because of the provision of the opening 92 for the substrate 91. Due to a change in the pressure caused by vibration of the actuator 40, this circular exposed portion of the planar section 51 can vibrate at substantially the same frequency as the actuator 40. Because of the configuration of the planar section 51 and the substrate 91, the portion at or near the center of the actuator facing area of the planar section 51 serves as a thin sheet portion that can perform a bending vibration, while the peripheral portion of the planar section 51 serves as a thick plate portion that is substantially restrained. This circular thin sheet portion is designated to have a natural frequency that is the same as or slightly lower than the driving frequency of the actuator 40. Accordingly, in response to vibration of the actuator 40, the exposed portion of the planar section 51 around the center vent 52 also vibrates at a high level of amplitude. If the vibration phase of the planar section 51 is later than that of the actuator 40 (e.g., 90° delay), a thickness change of the gap between the planar section 51 and the actuator 40 substantially increases. As a result, capabilities of the pump can further be improved.

The lid 54 is placed on the top of the spacer 53C so as to cover around the actuator 40. Accordingly, a fluid sucked through the center vent 52 is discharged from a discharge vent 55. The discharge vent 55 may be provided at the center of the lid 54. However, the discharge vent 55 is used to release a positive pressure within the housing including the lid 54, and thus, it does not have to be provided at the center of the lid 54.

A drive voltage is applied to external terminals 63 and 72 shown in FIG. 9 so as to cause the actuator 40 to perform a bending vibration, whereby a fluid is sucked through the center vent 52 at the bottom and is discharged from the discharge vent 55.

Figure 11:
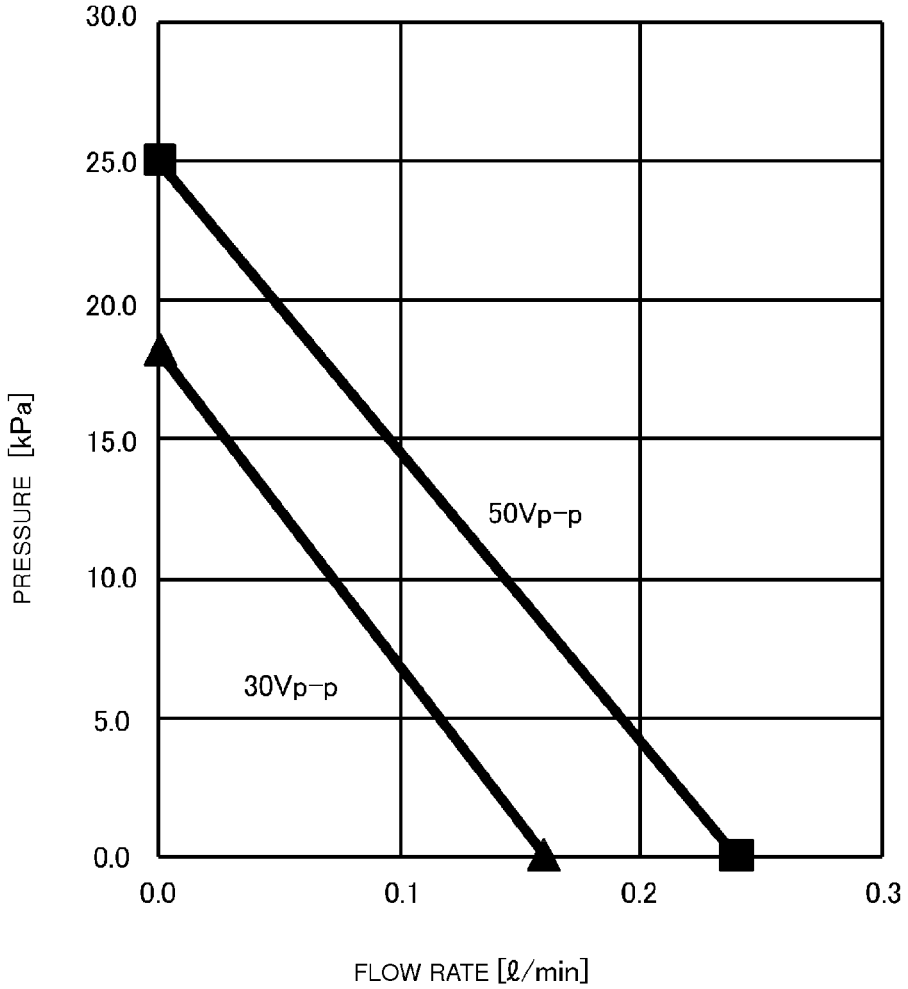
FIG. 11 illustrates P-Q characteristics when the fluid pump 105 of the fifth preferred embodiment performs a negative pressure operation by allowing a discharge vent 55 of the fluid pump 105 to be opened to atmosphere and by sucking air through a center vent 52.

FIG. 11 illustrates P-Q characteristics when the fluid pump 105 of the fifth preferred embodiment performs a negative pressure operation by allowing the discharge vent 55 of the fluid pump 105 to be opened to atmosphere and by sucking air through the center vent 52. The horizontal axis indicates the flow rate, while the vertical axis indicates the pressure. The P-Q characteristics are shown when the fluid pump 105 is driven at a drive voltage of 30 Vp-p and of 50 Vp-p. A fluid pump using a diaphragm of the related art having substantially the same size as that of the fluid pump 105 exhibits capabilities of a maximum pressure of 10 kPa and a maximum flow rate of 0.02 l/min at a drive voltage of 90 Vp-p. FIG. 11 shows that, in the fluid pump 105, at half a drive voltage of 90 Vp-p, a pressure level of about twice that of 10 kPa and a flow rate of about ten times that of 0.02 l/min are obtained.

The fluid pump 105 of the fifth preferred embodiment may be used as a cathode air blower in a fuel cell, for example.

Sixth Preferred Embodiment

Figure 12A:
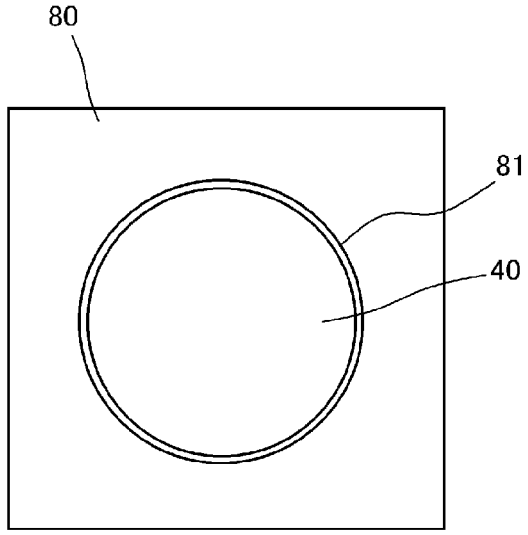
FIG. 12A illustrates an example of a position retaining structure for an actuator 40 of a fluid pump according to a sixth preferred embodiment of the present invention.
Figure 12B:
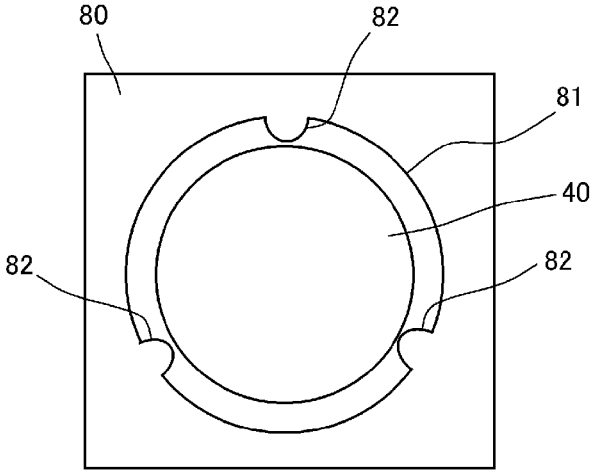
FIG. 12B illustrates an example of a position retaining structure for the actuator 40 of the fluid pump according to the sixth preferred embodiment of the present invention.

FIGS. 12A and 12B illustrate examples of a position retaining structure for an actuator 40 of a fluid pump according to a sixth preferred embodiment. The fluid pump of the sixth preferred embodiment has a structure in which a position retaining frame 80 surrounds the periphery of the actuator 40 of the fluid pump of the second preferred embodiment. The actuator is accommodated within an opening 81 of the position retaining frame 80 fixed to a planar section (not shown).

In the example shown in FIG. 12A, the circular opening 81 is provided in the position retaining frame 80, and the disk-shaped actuator 40 is disposed within the opening 81. The internal diameter of the opening 81 is slightly larger than the external diameter of the actuator 40. Accordingly, the actuator can be accommodated within the opening 81 of the position retaining frame 80 without restraining the peripheral portion of the actuator 40.

Connection of the actuator 40 shown in FIG. 12A to an electrode located on the piezoelectric element may be performed via a conductor wire. With this arrangement, even if the actuator 40 is driven substantially without being fixed to the planar section, it can be prevented from being displaced.

In the example shown in FIG. 12B, a generally circular opening 81 is provided in a position retaining frame 80, and three projections 82 are provided at the position retaining frame 80 so that the disk-shaped actuator 40 can contact the position retaining frame 80 at three points when the disk-shaped actuator 40 is disposed within the opening 81. Those projections 82 are provided with clearances so that the three projections 82 are not in contact with the actuator 40 at the same time. Accordingly, the actuator 40 can be accommodated within the opening 81 of the position retaining frame 80 without restraining the periphery of the actuator 40. With this arrangement, even if the actuator 40 is driven substantially without being fixed to the planar section, it can be prevented from being displaced. Additionally, because of the provision of the projections 82, the contact area of the actuator 40 with the position retaining frame 80 is small, thereby reducing impact on the piezoelectric element of the actuator. The thickness along the height of the position retaining frame 80 in the sixth preferred embodiment is preferably larger than a maximum displacement position of the peripheral portion of the actuator 40. Additionally, an electrical connection of the actuator 40 to an electrode located on the piezoelectric element may be implemented via a conductor having elasticity (not shown), such as a conductor wire.

Seventh Preferred Embodiment

Figure 13:
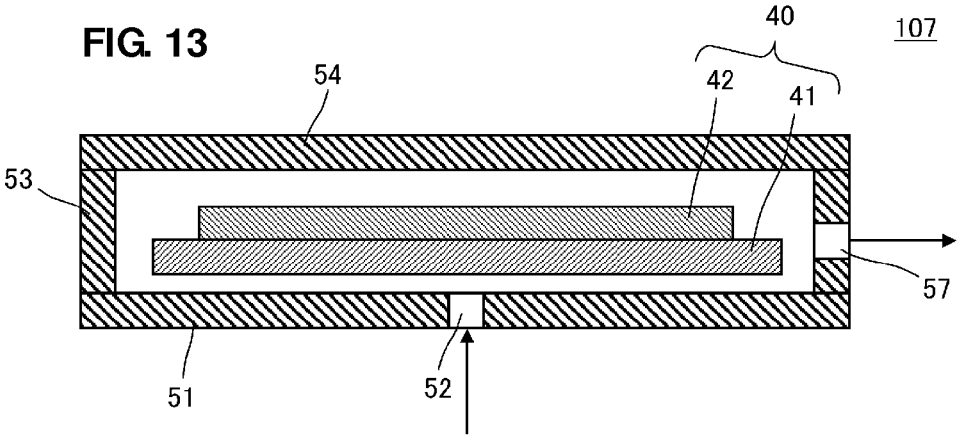
FIG. 13 is a sectional view illustrating the major portion of a fluid pump 107 according to a seventh preferred embodiment of the present invention.

FIG. 13 is a sectional view illustrating the major portion of a fluid pump 107 according to a seventh preferred embodiment. The fluid pump 107 includes an actuator 40 and a planar section 51. The actuator 40 is formed preferably by attaching a disk-shaped piezoelectric element 42 to a disk-shaped diaphragm 41. As in the fourth and fifth preferred embodiments, the actuator 40 is retained by a diaphragm support frame 61 including connecting portions 62 having an elastic structure. A spacer 53 and a lid 54 that surround the periphery of the actuator 40 are provided on the top of the planar section 51. A discharge vent 57 is preferably provided in the spacer 53.

When the actuator 40 performs a bending vibration, a fluid is sucked through a center vent 52 in accordance with the principle described in the first preferred embodiment. The sucked fluid is discharged from the discharge vent 57. Accordingly, the fluid pump 107 can discharge a fluid sideways in a direction perpendicular or substantially perpendicular to the thickness direction.

Eighth Preferred Embodiment

Figure 14:
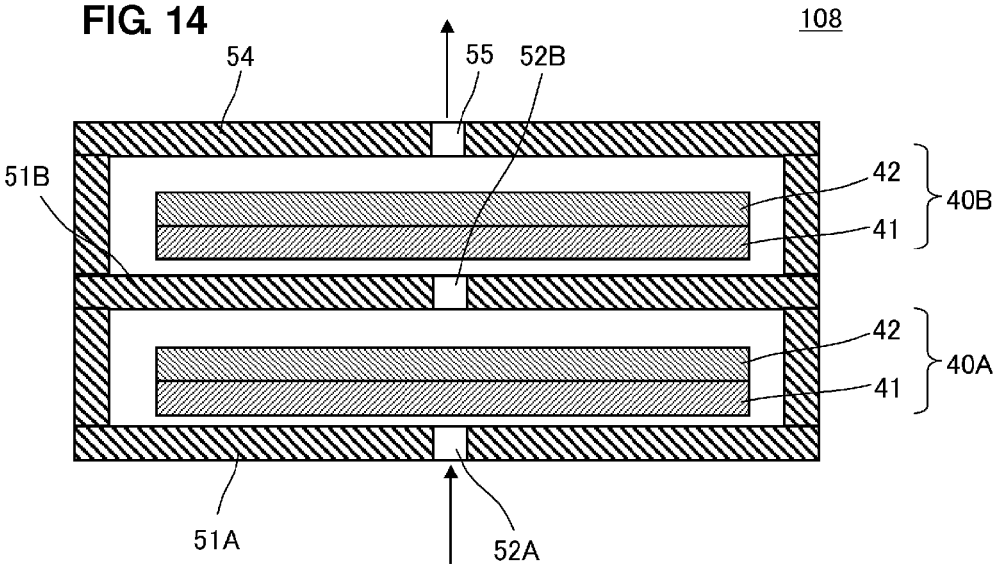
FIG. 14 is a sectional view illustrating the major portion of a fluid pump 108 according to an eighth preferred embodiment of the present invention.

FIG. 14 is a sectional view illustrating the major portion of a fluid pump 108 according to an eighth preferred embodiment. The fluid pump 108 has a structure in which two fluid pumps, each being the fluid pump 104 shown in FIG. 4, are stacked. In FIG. 14, a lid is provided. However, in this example, the planar section of the upper pump also serves as the lid of the lower pump. A center vent 52B of the upper pump also serves as a discharge pump of the lower pump.

In this manner, by connecting two fluid pumps in series with each other, in comparison with a single fluid pump, the suction/discharge pressure is doubled although the flow rate is the same. Similarly, by connecting N pumps in series with each other, the suction/discharge pressure can be increased by a factor of N. In this case, too, the planar section may also be used as the lid, thereby making the overall configuration compact.

Ninth Preferred Embodiment

Figure 15:
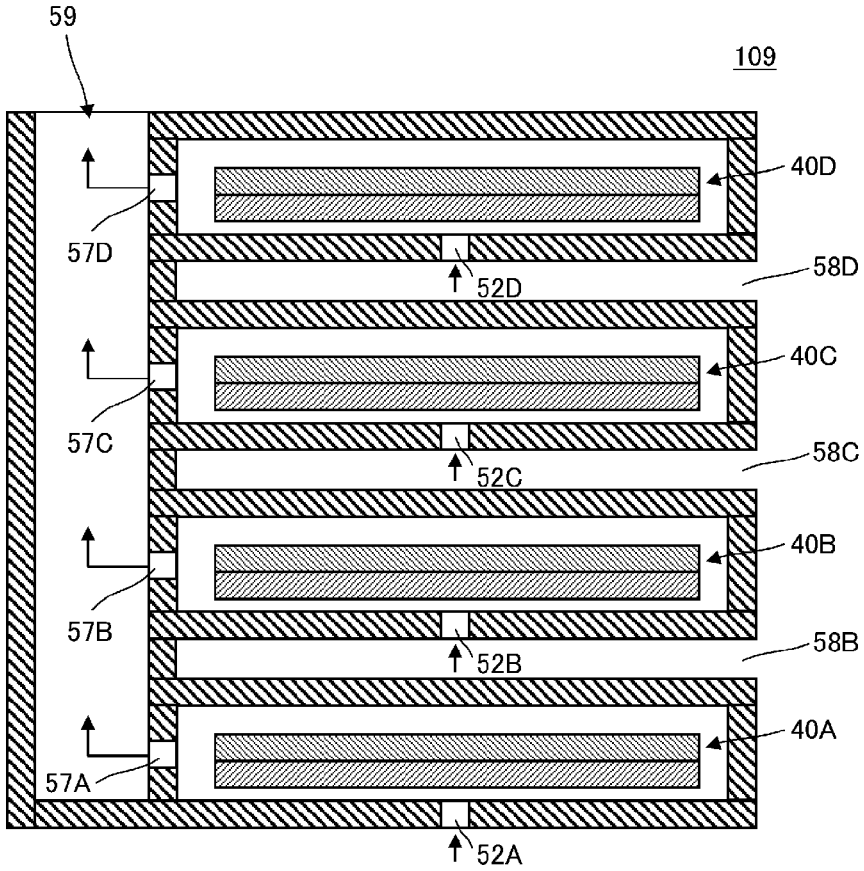
FIG. 15 is a sectional view illustrating the major portion of a fluid pump 109 according to a ninth preferred embodiment of the present invention.

FIG. 15 is a sectional view illustrating the major portion of a fluid pump 109 according to a ninth preferred embodiment. The fluid pump 109 has a structure in which four fluid pumps, each being the fluid pump 107 shown in FIG. 13 are stacked. However, inflow channels 58B, 58C, and 58D are provided so that center vents 52A, 52B, 52C, and 52D are not closed. Moreover, an outflow channel 59 is provided for a fluid to be discharged from discharge vents 57A, 57B, 57C, and 57D.

In this manner, by connecting four fluid pumps in parallel with each other, in comparison with a single fluid pump, the flow rate is quadrupled although the suction/discharge pressure is the same.

Tenth Preferred Embodiment

Figure 16:
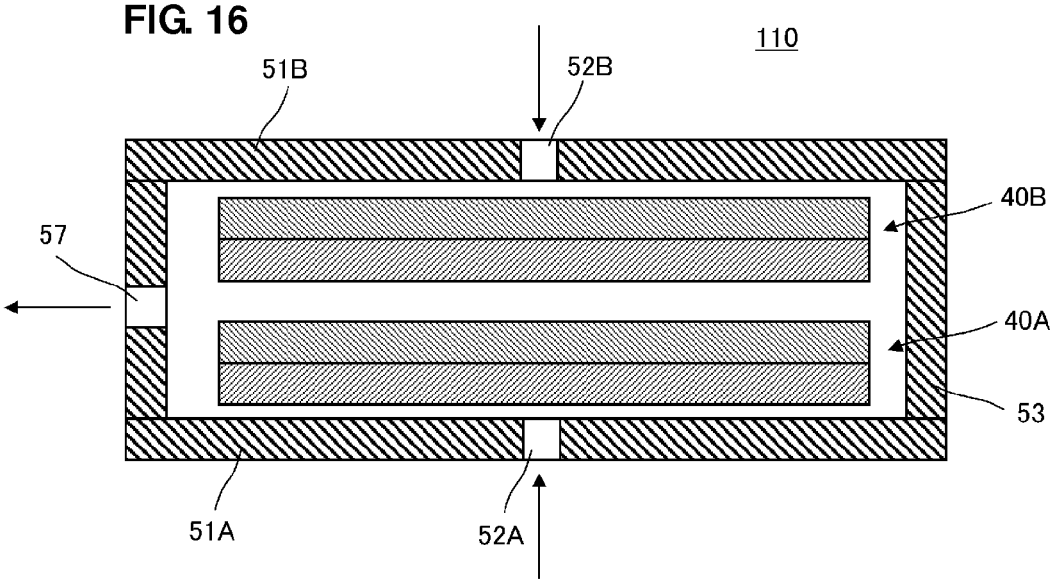
FIG. 16 is a sectional view illustrating the major portion of a fluid pump 110 according to a tenth preferred embodiment of the present invention.

FIG. 16 is a sectional view illustrating the major portion of a fluid pump 110 according to a tenth preferred embodiment. In the fluid pump 110, two actuators 40A and 40B are provided within one housing. As in the fourth and fifth preferred embodiments, each of the actuators 40A and 40B is provided with a diaphragm support frame 61 including connecting portions 62 having an elastic structure and is supported by the diaphragm support frame 61. A discharge vent 57 is provided in a portion of a spacer 53. With this structure, a planar section 51A and an actuator 40A perform a pumping operation, while a planar section 51B and an actuator 40B perform a pumping operation. Since the two actuators 40A and 40B perform a bending vibration in synchronization with each other, a fluid is sucked through center vents 52A and 52B at the same time, and is discharged from the discharge vent 57. In this fluid pump, in a practical sense, two pumps are integrated, and thus, the flow rate is doubled in comparison with a fluid pump including a single actuator.

Eleventh Preferred Embodiment

Figure 17:
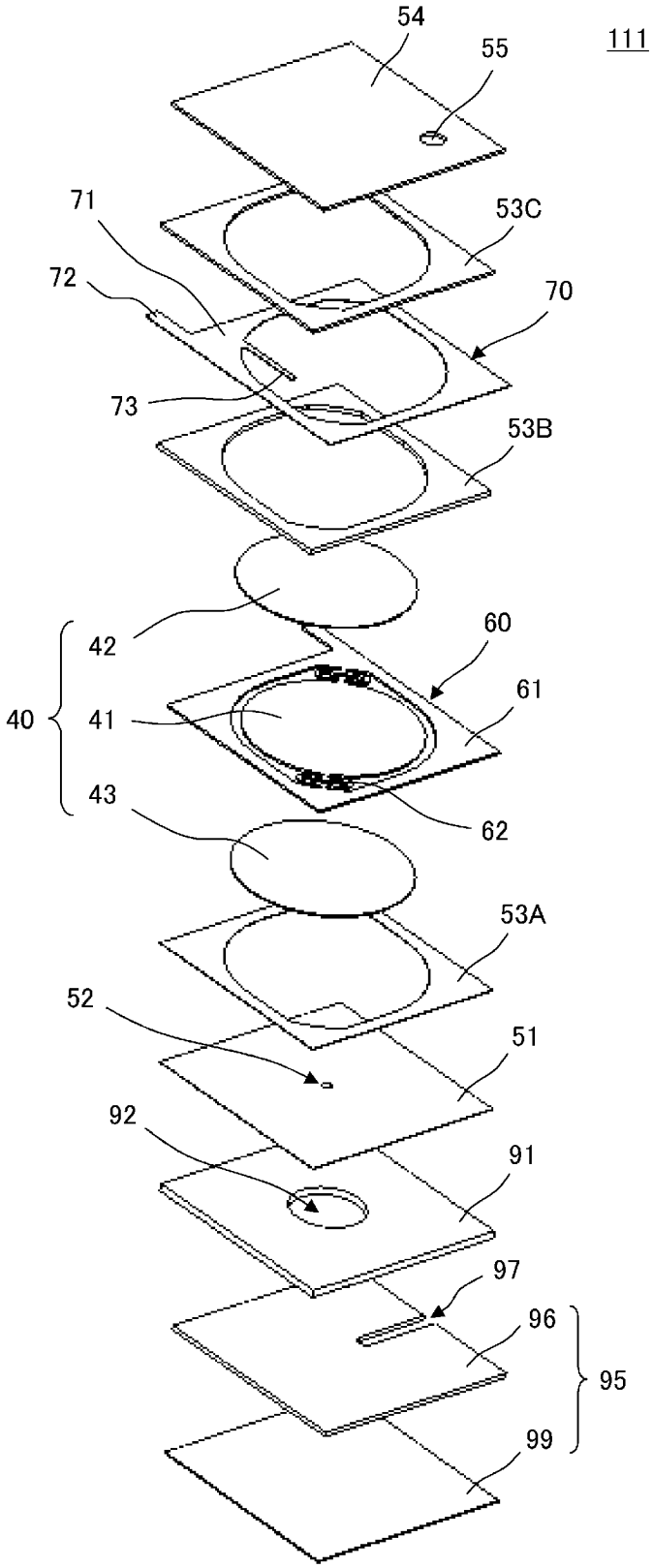
FIG. 17 is an exploded perspective view illustrating a fluid pump 111 according to an eleventh preferred embodiment of the present invention.
Figure 18:
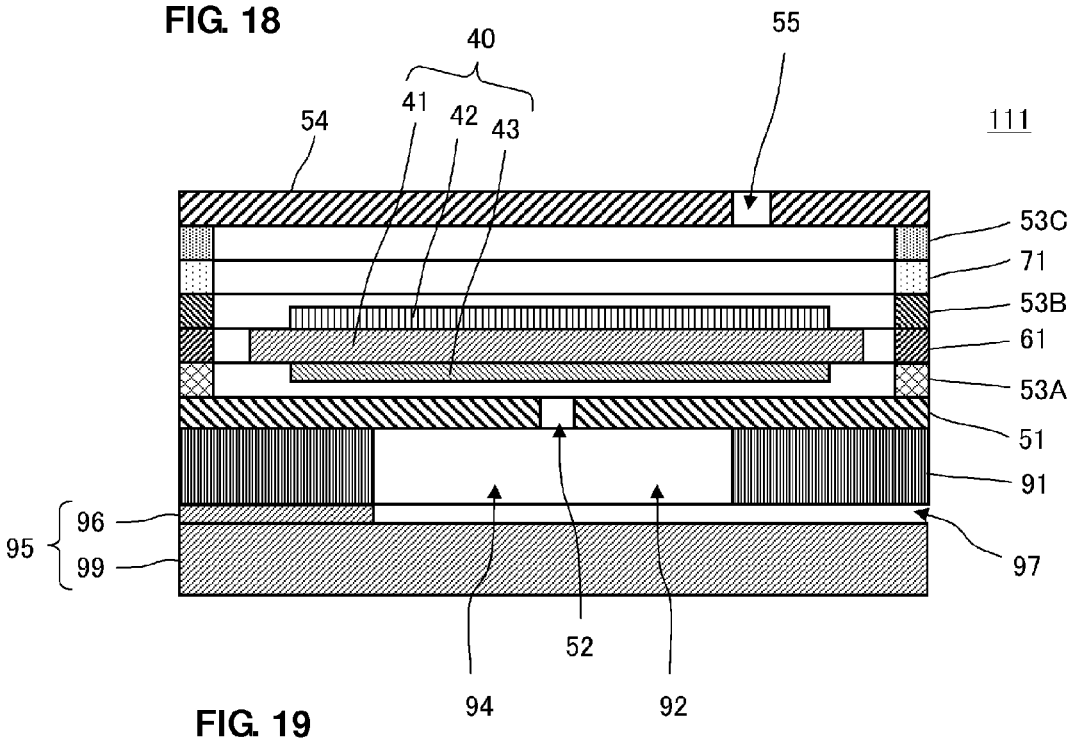
FIG. 18 is a sectional view illustrating the major portion of the fluid pump 111 according to the eleventh preferred embodiment of the present invention.

FIG. 17 is an exploded perspective view illustrating a fluid pump 111 according to an eleventh preferred embodiment. FIG. 18 is a sectional view illustrating the major portion of the fluid pump 111 according to the eleventh preferred embodiment. The fluid pump 111 according to this preferred embodiment differs from the fluid pump 105 according to the fifth preferred embodiment in an actuator 40 and a cover plate unit 95. The configuration of the other portions is preferably the same as that of the fluid pump 105.

The thickness of a spacer 53A is a length obtained by adding about several tens of μm, for example, to the thickness of a reinforcing plate 43. The thickness of a spacer 53B is preferably the same as or slightly thicker than the thickness of a piezoelectric element 42.

A detailed description will be given below. The actuator 40 has a structure in which the piezoelectric element 42, a diaphragm 41, and a reinforcing plate 43 are bonded in this order from above.

Then, the cover plate unit 95 is formed preferably by bonding a channel plate 96 and a cover plate 99. The cover plate unit 95 is bonded to a thick plate portion such that it faces a thin sheet portion, and defines an internal space 94 together with the thin sheet portion and the thick plate portion. As stated above, the thin sheet portion is a circular central portion of the planar section 51 that is exposed through the opening 92 of the substrate 91 in FIG. 10. The thin sheet portion vibrates at substantially the same frequency as the actuator 40 due to a change in the pressure caused by the vibration of the actuator 40. Moreover, as stated above, the thick plate portion is a portion defined by the substrate 91 and the peripheral portion outer than the central portion of the planar section 51.

A vent groove 97 arranged to communicate the internal space 94 with the outside of the housing of the fluid pump 111 is provided in the cover plate unit 95.

In this preferred embodiment, a drive voltage is applied to external terminals 63 and 72 so as to cause the actuator 40 to perform a bending vibration, whereby air is sucked from the vent groove 97 via the center vent 52 and is discharged from the discharge vent 55.

Figure 19:
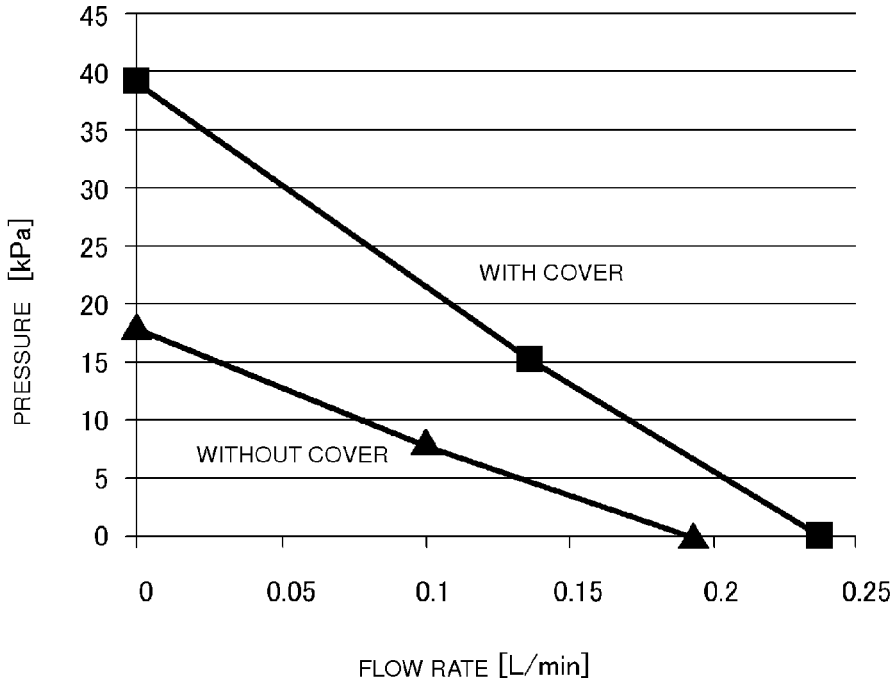
FIG. 19 illustrates P-Q characteristics when the fluid pump 111 of the eleventh preferred embodiment of the present invention performs a negative pressure operation by allowing a discharge vent 55 of the fluid pump 111 to be opened to atmosphere and by sucking air through a center vent 52.

FIG. 19 illustrates P-Q characteristics when the fluid pump of the eleventh preferred embodiment performs a negative pressure operation by allowing the discharge vent 55 of the fluid pump 111 to be opened to atmosphere and by sucking air through the center vent 52. FIG. 19 shows an experimental result obtained by measuring the flow rate and the pressure when the fluid pump 111 with the cover plate unit 95 and a fluid pump from which the cover plate unit 95 is removed from the fluid pump 111 are driven at a drive voltage of 30 Vp-p.

The experiment shows that the fluid pump without the cover plate unit 95 exhibits capabilities of a maximum pressure of 18 kPa and a maximum flow rate of 0.195 l/min, while the fluid pump with the cover plate unit 95 exhibits improved capabilities of a maximum pressure of about 40 kPa and a maximum flow rate of about 0.235 l/min, for example.

The reason why the above-described experimental result has been obtained may be as follows. Because of the provision of the cover plate unit 95, the generation of a pressure wave or a synthetic jet flow around the center vent 52 of the planar section 51 caused by vibration of the actuator 40 and the central portion (i.e., thin sheet portion) of the planar section 51 has been prevented and suppressed. In addition to this reason, various factors may be assumed, for example, the phase of vibration or the center of the amplitude of vibration of the central portion of the planar section 51 has been displaced because of the provision of the cover plate unit 95.

As described above, in the fluid pump 111 according to this preferred embodiment, the pressure and flow rate that can be generated, i.e., pumping capabilities, can be significantly improved.

Other Preferred Embodiments

In the above-described preferred embodiments, a unimorph actuator preferably is provided. However, a bimorph actuator may be provided by attaching a piezoelectric element to each of the surfaces of the diaphragm.

The present invention is not restricted to an actuator provided with a piezoelectric element, but is applicable to an actuator that is electromagnetically driven to perform a bending vibration.

In the above-described preferred embodiments, the size of the piezoelectric element preferably is substantially the same as the diaphragm. However, the size of the diaphragm may be larger than the piezoelectric element.

If the present invention is applied for a use in which the generation of audible sound is negligible, the actuator may be driven in an audible frequency band.

In the above-described preferred embodiments, one center vent 52 is preferably disposed at or in an area adjacent to the center of the actuator facing area of the planar section 51. However, a plurality of center vents may be disposed at or in an area adjacent to the center of the actuator facing area.

In the above-described preferred embodiments, in a fluid pump including a discharge vent, a negative pressure operation is preferably performed by opening the discharge vent to be exposed to air and by sucking air through the center vent. Conversely, a positive pressure operation may be performed by opening the center vent to be exposed to air and by discharging air from the discharge vent.

In the above-described preferred embodiments, the frequency of the drive voltage is preferably set so that the actuator 40 vibrates in the first mode. However, the frequency of the drive voltage may be set so that the actuator 40 vibrates in another mode, such as the third-order mode.

In the above-described preferred embodiments, a disk-shaped piezoelectric element and a disk-shaped diaphragm are preferably provided. However, one of the diaphragms may be rectangular or polygonal, for example.

A fluid which is sucked or sucked/discharged is not restricted to air, but may be a liquid.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fluid pump comprising:

an actuator including a disk-shaped diaphragm and a piezoelectric element provided on the disk-shaped diaphragm;

a planar section disposed such that the planar section faces the actuator while being in proximity to the actuator;

at least one center vent is disposed in a portion at or in an area adjacent to a center of an actuator facing area of the planar section that faces the actuator;

a diaphragm support frame which retains the diaphragm with a gap between the diaphragm support frame and an outer circumference of the diaphragm;

a conductive connecting portion provided between diaphragm support frame and the diaphragm and supporting the outer circumference of the diaphragm, the conductive connecting portion having an elastic structure; wherein the actuator performs a bending vibration from a central portion of the actuator to a peripheral portion of the actuator such that the actuator is not in contact with the planar section at least while the actuator is being driven; and a drive voltage is applied to the diaphragm through the conductive connecting portion from the diaphragm support frame.

2. The fluid pump according to claim 1, wherein the portion at or in the area adjacent to the center of the actuator facing area includes a thin sheet portion that performs a bending vibration, and a peripheral portion of the actuator facing area includes a thick plate portion that is substantially restrained.

3. The fluid pump according to claim 2, further comprising a cover plate unit that is attached to the thick plate portion such that the cover plate faces the thin sheet portion so as to define an internal space together with the thin sheet portion and the thick plate portion, wherein at least one vent groove arranged to allow the internal space to communicate with an outside of a housing of the fluid pump is provided in the cover plate unit.

4. The fluid pump according to claim 1, wherein at least one peripheral vent is provided at a peripheral portion of the actuator facing area.

5. The fluid pump according to claim 1, wherein the actuator is retained by the conductive connecting portion such that another gap is provided between the actuator and the planar section.

6. The fluid pump according to claim 1, wherein a position retaining structure including an opening arranged to position the actuator is provided on the planar section, and the actuator is accommodated within the opening.

* * * * *